US005103903A

United States Patent [19]

Marks, II

[11] Patent Number: 5,103,903

[45] Date of Patent: Apr. 14, 1992

[54] JAR

[76] Inventor: Alfred R. Marks, II, P.O. Box 1206, Liberty, Tex. 77575

[21] Appl. No.: 625,000

[22] Filed: Dec. 10, 1990

Related U.S. Application Data

[63] Continuation-in-part of Ser. No. 570,965, Aug. 21, 1990, abandoned, which is a continuation of Ser. No. 469,754, Jan. 17, 1990, abandoned, which is a continuation of Ser. No. 349,899, May 5, 1989, abandoned, which is a continuation of Ser. No. 88,962, Aug. 24, 1987, abandoned.

[51] Int. Cl.[5] ..... E21B 31/107

[52] U.S. Cl. ..... 166/178; 175/304

[58] Field of Search ..... 166/178; 175/300, 304, 175/306

[56] References Cited

U.S. PATENT DOCUMENTS

| | | | |
|---|---|---|---|
| 1,798,337 | 3/1931 | Newson | 175/304 |
| 1,803,732 | 5/1931 | Shaffer | 175/304 |
| 2,247,560 | 7/1941 | Phipps | 175/304 |
| 2,875,983 | 3/1959 | Sutliff | 175/304 |
| 3,208,541 | 9/1965 | Lawrence | 175/304 |
| 3,853,187 | 12/1974 | Sutliff et al. | 175/304 |
| 3,880,249 | 4/1975 | Anderson | 175/302 |
| 3,963,081 | 6/1976 | Anderson et al. | 175/304 |
| 4,109,736 | 8/1978 | Webb et al. | 175/304 |
| 4,846,273 | 7/1989 | Anderson et al. | 175/300 |

*Primary Examiner*—Thuy M. Bui

*Attorney, Agent, or Firm*—Dodge, Bush, Moseley & Riddle

[57] ABSTRACT

A new and improved mechanical jar apparatus for delivering downhole blows in a wellbore in either of opposite directions in response to the controlled application of a longitudinal force. A plurality of mechanically released collets are employed to releasably secure the concentric telescoping members of the jar apparatus in the ready condition until the longitudinal actuation force is applied to move the telescoping members to the longitudinally extended or compressed jarring positions. The plurality of collets may be arranged for controlling the magnitude and direction of the jarring force without inadvertently triggering a jarring force in the undesired direction.

2 Claims, 3 Drawing Sheets

JAR

CROSS REFERENCE TO RELATED APPLICATION

This application is a continuation-in-part of application Ser. No. 07/570,965, filed Aug. 21, 1990, now abandoned, which was a continuation of application Ser. No. 07/469,754, filed Jan. 17, 1990, now abandoned, which was a continuation of application of Ser. No. 07/349,899, filed May 5, 1989, now abandoned, which was a continuation of application Ser. No. 07/088,962, filed Aug. 24, 1987, now abandoned.

BACKGROUND OF THE INVENTION

1. Field of the Invention

The field of the present invention relates generally to Jars and more particularly to Jars useful in wells for producing hydrocarbons and other earth fluids.

2. Background Art

Earth bore holes or wells may be formed for many useful purposes including the production of hydrocarbons or other well fluids from subsurface formations. Due to the manner or nature of the formation of such wells, access to the well below the earth surface is severely limited. During drilling or use of wells, various well tools or apparatus may become lodged or stuck at a subsurface location. In addition, it may become desirable to deliver an impact or blow of substantial force at a subsurface location in the well for other purposes. To free a stuck well tool or otherwise deliver such a blow for any desired purpose, special well tools, generically known as jars, have been developed. In general, jars use the sudden release of tension or compression energy built up in a connected wire line or well conduit to deliver the desired blow. Both well pipe string or wire line mounting and actuation of jars is known and commercial accepted conventional practice. Jars are also frequently used in well fishing operations to recover a lost tool or subject, known as a fish, from the well.

Jars are sometimes confused with structurally similar well tools called bumper subs that have an entirely different purpose. A bumper sub is a well tool that forms part of the rotary drill pipe used in well drilling operations from a floating vessel. The bumper sub provides a splined longitudinal slip joint to maintain the rotating drill bit in contact with the bottom of the bore hole by compensating for the up and down motion of the floating drilling vessel.

Under the patent office subject matter classification system issued patents claiming jarring tools may be located in class 166 (wells) or class 175 (boring or penetrating the earth). Such jar tools or below ground hammer or impact apparatus may be made responsive in operation to actuation by various types of manipulation such as a relative rotational movement. Due to the numerous thread connections and the torsional strain or elasticity in the tubular string mounting a jar, rotational control or actuation of a jarring tool is not as precise or certain as desired. For these reasons, jars are preferably triggered or actuated by a longitudinally applied push or pull force. Such longitudinal force may result from either the application of a specified weight force to the jar tool (compression) or by the application of a specific tension or upward pull on the wire line or well tubing string. These trigger forces can be easily controlled and monitored at the earth's surface by the operator with conventional drill string weight monitoring or indicating equipment. To prevent inadvertent operation of the jar, the trigger forces are normally in excess of those usually applied to the jar during routine well operation and the resulting jar impact can be directed either upwardly or downwardly. Some jars are arranged to deliver blows in both directions.

An example of a fluid operated jar is disclosed in U.S. Pat. No. 4,524,838 to Sutliff. Fluid is trapped in an expansible chamber to enable an energy build up. When the fluid is released, operation of the jar converts the energy of the wire line or well string into the desired jarring blow.

Because of the size limitations resulting from bore hole dimensions, fluid operated jars have been widely used. Large hammer forces can be repeatedly generated with a minimum of tool diameter and tool wall thickness, thereby reducing the adverse effects of employing a jar in the tubular string. The severe operating conditions experienced by jars downhole may result in seal failure. Because a seal failure will render such trapped fluid operated jar devices inoperative they have not been as reliable as many operators have desired. Also, fluid operated jars are usually limited to jarring in a single direction.

As disclosed in the Sutliff Patent, drillers or operators have found it useful in jarring operations to occasionally alternate successively upward jarring blows with a downward jarring blow. This technique, known as "spudding" is sometimes used when a keyhole slot condition is encountered. In addition, in cocking or resetting a jar that can deliver a blow in either direction, a blow in the undesired direction may inadvertently result. As this can result in well tool damage or creation of a fish, this is not a desirable feature or characteristic. More importantly, the sequence of alternate direction blows is often off-setting and may result in a self-defeating failure to accomplish the intended purpose or task.

In U.S. Pat. No. 2,241,477 to Rasmussen a mechanically operated well jar apparatus for delivering a relatively light impact for wireline operations is disclosed. A radially yieldable member controls the relative telescoping movement of the outer tubular member and the inner mandrel. As a predetermined wire line tension energy level, the longitudinally slotted outer tubular body providing the detente expands radially outwardly adjacent an annular slip shoulder to release the inner mandrel. The released mandrel moves upwardly to deliver an upwardly directed blow to the impact collar of the outer tubular member. The jar is reset by slacking off on the wireline for enabling the delivery of repeated upwardly directed blows. Also disclosed is an adjustable impact jar embodiment having a helical thread arrangement on the mandrel to control the strength or magnitude of the jarring energy by varying the stroke distance between the hammer and anvil.

An object of the present invention is to provide a new and improved jar apparatus for use in wells.

A further object of the present invention is to provide a new and improved jar apparatus for use in wells having a minimum of parts.

Yet another object of the present invention is to provide a new and improved jar apparatus that may be easily controlled to avoid a blow in an undesired direction.

SUMMARY OF THE INVENTION

A new and improved straight push or pull actuated mechanically operated jar apparatus for use in wells and arranged to deliver either upwardly or downwardly directed blows is disclosed. The jar apparatus includes a pair of concentrically disposed tubular members that are arranged for limited relative telescopic movement and are held against relative circumferential rotation by a conventional splined arrangement. Preferably, the tubular members are sealed to prevent leakage of fluid therebetween.

The telescoping tubular members are relatively movable to and from an extended position and a compressed position. Hammer means and anvil means are brought into violent engagement at both the extended and compressed positions for delivering the desired directional impact blow. Resiliently deformable releasable securing means are provided for normally holding or securing the telescoping tubular members at an operating location or in a ready condition intermediate the extended position and the compressed position. The securing means are releasable by application of a longitudinal force in excess of a predetermined amount to move the tubular members from the ready condition to the extended or compressed jarring position. The securing means may thereafter be reengaged by relative longitudinal movement of the tubular members to deliver repeated blows in the desired direction. When moving the tubular members to reengage the securing means, proper longitudinal spacing of the securing means in the ready condition an intermediate position of substantially 6 inches in length at of travel is provided to avoid inadvertent actuation of the jar to deliver an undesired blow in the opposite direction.

DESCRIPTION OF THE PREFERRED EMBODIMENT

The jar apparatus of .the present invention, generally designated A in the Figures, is particularly useful in wells to deliver a directional impact or blow of substantial force at a subsurface location. As such useful purposes of a jar apparatus A are recognized and well known to those skilled in the art, those uses need not be detailed herein. And while the illustrated embodiment is in the form of a rugged drilling jar, it should also be understood that the jar apparatus A of the present invention may be modified by those skilled in the art for other well operations or downhole applications.

Figure 1:
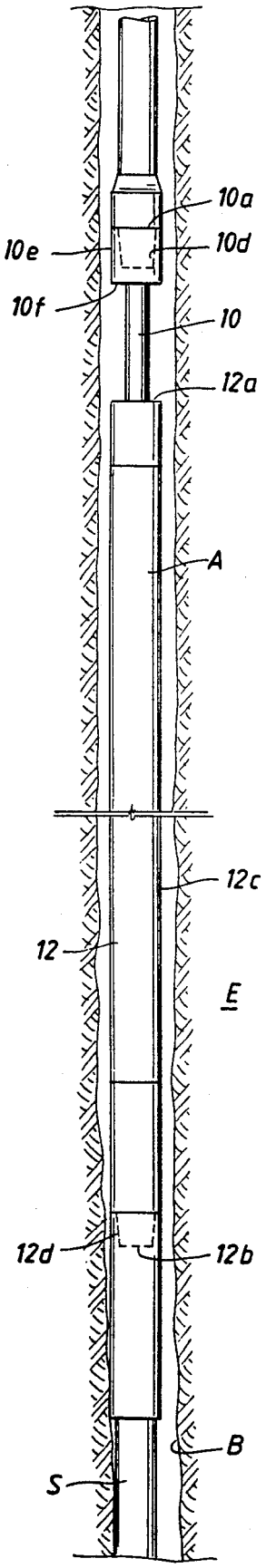
FIG. 1 is a side view of the jar apparatus of the present invention operably connected in a tubular conduit disposed in a well bore.

As illustrated in FIG. 1, the jar apparatus A is mounted in and forms a portion of a well conduit or rotary drill string S extending through a well bore B formed in earth E. The connected jar apparatus A preferably also forms a portion of the contained fluid flow path provided by the drill string S for circulating well fluids. Other well tools, such as a rotary drill bit (not illustrated), may be mounted in the drill string S for conducting desired well operations. The rotary drill string S is supported and controlled in the conventional manner at and extends downwardly from the earth's surface (not illustrated) to a preselected subsurface location below the jar apparatus A in the well bore B for conducting the desired well operations.

The jar apparatus A includes a first or inner tubular member 10 operably connected with a second or outer tubular member 12. In the Figures, the member 10 is illustrated as in the upper position with it being understood that the jar apparatus A may be inverted during installation for use to place the member 12 above the member 10 in the well bore B. However, the installation arrangement illustrated is preferred.

Figure 2:
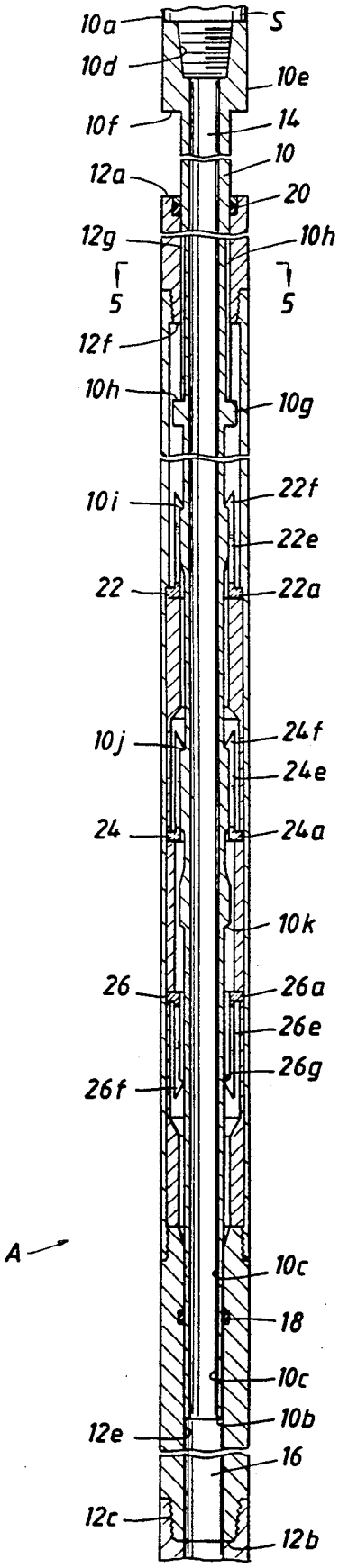
FIG. 2 is a side view, in section, of the jar apparatus of the present invention in the ready condition for delivering an upwardly directed hammer blow.
Figure 3:
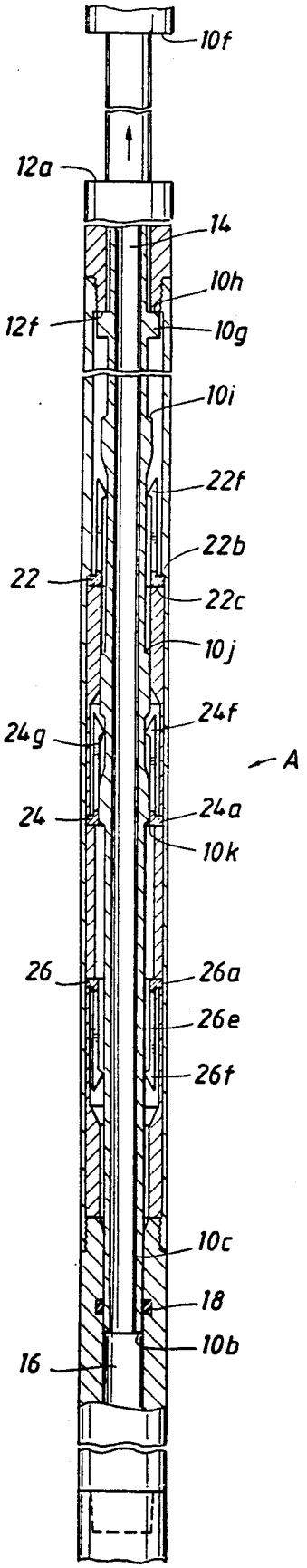
FIG. 3 is a view similar to FIG. 2 with the jar apparatus of the present invention shown in the extended position when delivering a downwardly directed hammer blow.
Figure 4:
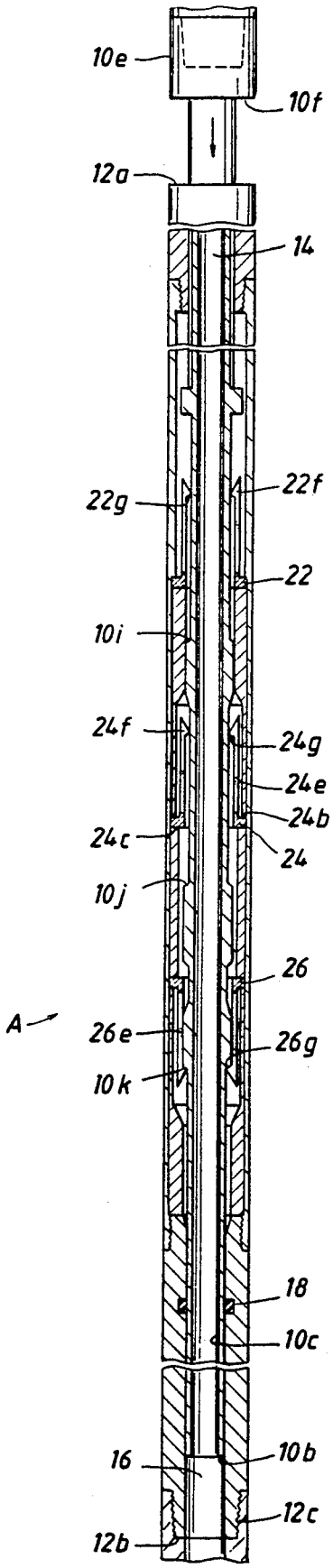
FIG. 4 is a view similar to FIG. 2 with the jar apparatus of the present invention in the ready condition for delivering a downwardly directed hammer blow.

As illustrated in FIGS. 2, 3, and 4, the first tubular member 10 extends downwardly from an upwardly facing annular shoulder 10*a* adjacent the upper portion of the drill string S to a downwardly facing annular shoulder 10*b*. An inner surface 10*c* defines a tubular bore or central flow passage 14 for communicating or flowing well fluids through the drill string S in the conventional manner. The surface 10*c* is formed on substantially a constant diameter to minimize flow resistance through the bore 14. Adjacent the shoulder 10*a* the inner surface 10*c* is provided with a suitable conventional internal helical thread (box) connection 10*d* or other suitable known means for releasably securing in the drill string S. The threaded connection 10*d* enables the mounting of the jar apparatus A in the drill string S at any desired location.

As illustrated in FIG. 1, the second tubular member 12 extends downwardly from an upwardly facing shoulder 12*a* to a downwardly facing annular shoulder 12*b* (illustrated in phantom). An outer surface 12*c* formed on a substantially constant diameter extends between the shoulders 12*a* and 12*b*. The second tubular member 12 is also provided with an external helical threaded connector or pin 12*d* formed on outer surface 12*c* for the same drill string S connection purpose as pin threads 10*d*.

The first and second tubular members 10 and 12 are concentrically disposed and arranged for providing limited relative telescoping movement therebetween. The second tubular member 12 forms an inner surface 12*e* (FIG. 2) defining a longitudinally aligned central bore or flow passage 16 extending between shoulders 12*a* and 12*b*. The bore 16 also operably receives a portion of the inner tubular member 10. The flow passages or bores 14 and 16 are placed or arranged in flow enabling communication for enabling substantially unrestricted well conduit flow in the drill string S through the jar apparatus A from adjacent upper box threads 10*d* to adjacent lower pin threads 12*d* in the usual and conventional manner.

In the preferred and illustrated embodiment, each of the tubular members 10 and 12 are formed of a plurality of sleeve sections joined together for assembly purposes to form the unitary member. While the parts referenced as 10 and 12 are described herein for simplicity as members, it will be understood that term is employed to describe an assembly of parts or components that function together as a unitary structure. Because of the resulting structure, the term tubular member will be used herein to describe the resulting sleeve assembly construction. The exact arrangement of the joining together of these various sections to form the members 10 and 12 is within the level of ordinary skill in the art and may be varied as desired. Preferably, conventional interengaged helical threads are utilized to join the various sections in a manner to promote ease of assembly. Other thread assembly arrangements than those illustrated for the members 10 and 12 may be employed by those skilled in the art. Suitable conventional threaded anti-rotation pins (not illustrated) may be also employed to prevent inadvertent disengagement of the section joining threads if desired.

The tubular member 10 forms an outer surface generally designated 10*e* which extends between the shoulders 10*a* and 10*b*. As best illustrated in FIG. 2, the surface 10*e* forms a downwardly facing annular shoulder surface 10*f* in near proximity to shoulder 10*a*. When the tubular members 10 and 12 are telescoped or moved to the collapsed or longitudinally compressed position (not illustrated) the shoulders 10*f* and 12*a* are brought into engagement to serve as movement stops to limit any further telescopic movement. In addition, the shoulder 10*f* serves as a hammer for delivering a desired impact force or blow to the anvil shoulder 12*a* for delivering a downwardly directed impact blow to the member 12 and the connected portion of the drill string S below the jar apparatus A.

Also formed on the outer surface 10*e* is a collar 10*g* (FIG. 2) having an upwardly forcing annular shoulder surface portion 10*h*. When the tubular members 10 and 12 are telescoped or moved to the longitudinally extended or stretched position (FIG. 3) the shoulder surface 10*h* engages a downwardly facing annular shoulder surface 12*f* formed on the tubular member 12 to prevent any further movement. When violently impacted the shoulder surface 10*h* serves as a hammer for striking the anvil shoulder 12*f* to impart an upwardly directed blow to the tubular member 12 and the connected drill string S below the jar apparatus A.

It will be immediately understood that when the jar apparatus A is installed inverted from the illustrated, the operation or functioning of the anvil shoulders and hammer shoulders is reversed.

Figure 5:
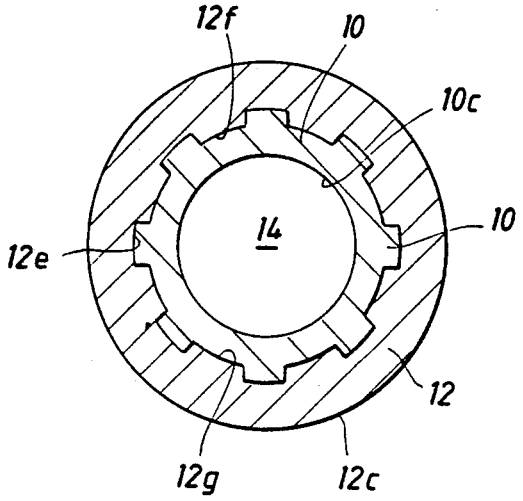
FIG. 5 is a cross-section view of the splined connection of the jar apparatus taken along lines 5—5 of FIG. 2.

Disposed between the shoulder 10*f* and the collar 10*g* is a plurality of splines 10*k* formed on the outer surface 10*e* (FIG. 2). A corresponding splined surface 12*g* is formed on the inner surface 12*e* of the tubular member 12. The inter-engaged splines 10*k* and 12*g* provide means for enabling or permitting the desired longitudinal slip joint or relative telescopic movement while preventing or blocking relative circumferential rotation between the members 10 and 12. Such inter-engaged spline arrangement is also illustrated in FIG. 5 and as such arrangement is both conventional and well known to those of ordinary skill in the art it will not be described in detail. Those skilled in the art may utilize other equivalent structure to the disclosed splines for performing these functions without departing from the present invention.

In order to preserve internal flow integrity of the drill string S for contained fluid circulation, a suitable packing 18 is provided adjacent shoulder 10*b* to form a suitable sliding seal between the tubular members 10 and 12 to prevent leakage of fluid therebetween. Other known sealing arrangements may be employed if desired. In certain applications, where flow integrity of the well conduit is not required or the jar apparatus A does not provide a flow path, the seal 18 may be omitted.

To prevent undesired entry of well bore fluids into the bore 16 which contains the operating mechanism of the jar apparatus A, a suitable wiper or packing 20 is provided adjacent shoulder 12*a*. The contained packing 20 establishes a continuous sliding seal between the tubular members 10 and 12 in the usual manner above the inter-engaged splines 10*k* and 12g.

In order to develop adequate and sufficient energy in the drill string S above the jar apparatus A to provide the desired blow, a means for releasably securing the tubular members 10 and 12 intermediate of the extended or compressed position is employed. When sufficient energy is built up, the means for securing is released and the tubular members 10 and 12 move rapidly from the intermediate securing position to deliver impact blow. While the term securing position or ready condition is used herein, it will be understood that the present invention employs separate securing positions for up jars and down jars. The securing position or ready condition is used herein to describe the position of the tubular members when they are in a cocked position for generating a jarring blow. By spacing these separate securing positions a desired distance, the jar apparatus A can be repeatedly cocked or resecured without inadvertently jarring in the undesired direction. When the tubular members are relatively disposed in the intermediate position between or in either of the separate securing positions the jar apparatus A is in the ready or cocked condition. By spacing the up and down jar securing positions a known distance, the operation is assured of adequate drill string control delivering jarring blows in only a single direction.

The means for releasably securing is provided by a plurality of mechanically operated collets 22, 24 and 26 mounted on one of the tubular members 10 or 12 operably engaging a co-acting shoulder formed on the other of the tubular members. In the illustrated embodiment the collets 22, 24, and 26 are fixedly mounted in a predetermined longitudinally spaced relationship on the outer tubular member 12. The collets 22, 24 and 26 operably engage tapered shoulders 10*l*, 10*m* and 10*n*, respectively, formed on tubular member 10 in operation as will be detailed hereinafter.

Figure 6:
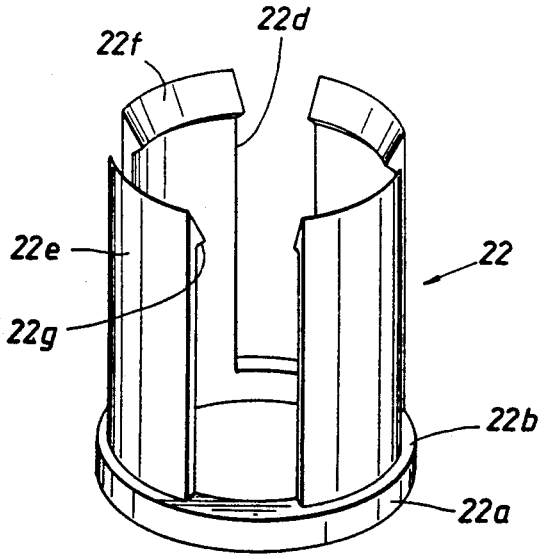
FIG. 6 is an isometric view of a typical releasable mechanically securing collet.
Figure 7:
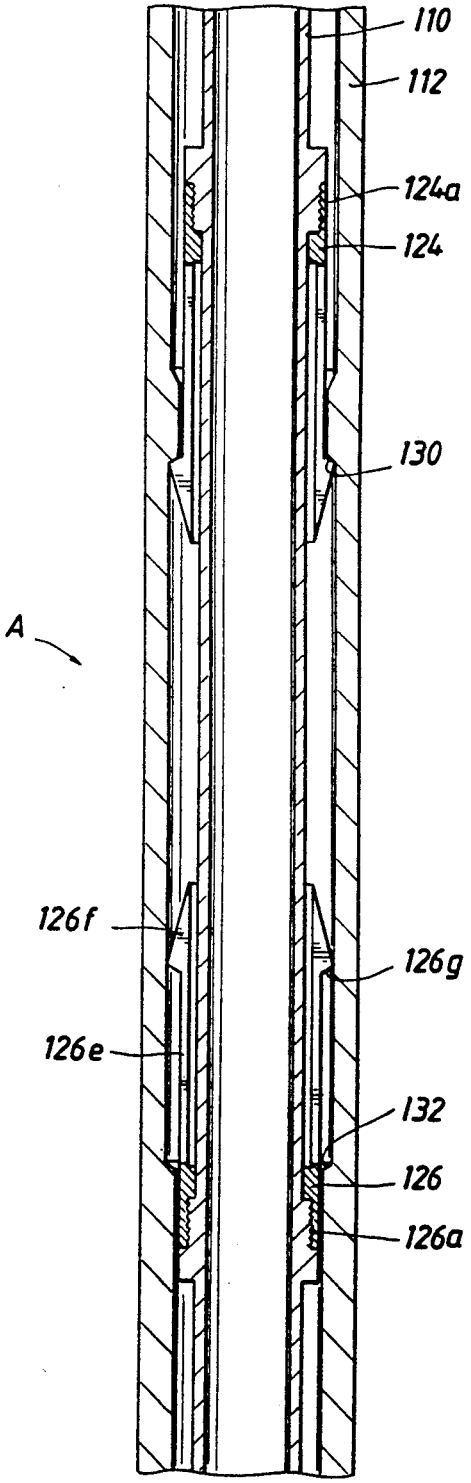
FIG. 7 is a detailed side view, in section, of an alternate embodiment having an oppositely facing arrangement of the releasable securing collets.

As collet member 22 is typical and illustrated in detail in FIG. 6, only collet 22 will be described in detail with the understanding that such written description is equally applicable to collets 24 and 26. The tubular collet member 22 is provided with a suitable securing ring portion 22*a* for mounting with the tubular member 10 or 12. In the illustrated embodiment the collets 22, 24 and 26 are mounted with the tubular member 12, but those skilled in the art will appreciate that one or more of the collets could be reversed in mounting location to the tubular member 10 as illustrated in FIG. 7. The ring portion 22*a* forms a collar having oppositely facing annular shoulders 22*b* and 22*c* that are trapped in conventional securing recesses forming co-acting oppositely facing securing shoulders for locking or trapping the collet ring 22*a* against longitudinal movement relative to the mounting member 12.

The collet 22 is provided with a suitable plurality of slots 22*d* that form a plurality of resilient or flexing cantilever arms 22*e* that terminate in detents 22*f* forming an interrupted annular securing shoulder surface 22*g*. By controlling the inclination angle or taper of the detent shoulder surfaces 22*g* the size or proportion of the weakening slots 22*d* or strength of arms 22*e*, the force at which the arms 22*e* will be forced by the tapered shoulder wedging action to flex radially for radially moving the detent shoulder surfaces 22*g* to release the engaged locking shoulder 10*l* can be determined and controlled.

The collets 24 and 26 are formed in the identical manner as collet 22 and like reference characters will be used to reference identical parts. To avoid repetition only the operation of the collet 22 and tapered locking shoulder 10*l* will be described in detail. When the tapered shoulder 10*l* is brought into engagement with the corresponding tapered shoulder 22*g*, the tubular members 10 and 12 are secured in the intermediate position and cocked or readied to deliver an upwardly directed blow. When the tension build up in the drill strings exceeds the holding force of the engaged shoulders 10*l* and 22*g*, the tapered engagement forces the detent mounting arms 22*e* to elastically flex radially outwardly to release the tubular member 10 which then springs or jumps upwardly to deliver the desired upward blow. During the upward movement of the tubular member 10, the detentes 22*f* ride on the outer surface 10*e*. To repeat the blow, the apparatus A may be recocked or placed in the ready condition by simply lowering the drill string S sufficiently to move the shoulder 10*l* below the detents 22*f*. The elastic strain on the arms 22*e* is automatically released to enable the detents 22*f* to move radially inwardly. Such radial movement enables the shoulders 10*l* and 22*g* to automatically again be brought into engagement for securing the tubular members 10 and 12 in the intermediate position.

The shoulder 10*m* and collet 24 are also arranged for operating essentially simultaneous with the shoulder 10*l* and collet 22. By doubling the releasable securing force with this series arrangement of collets 22 and 24, the build up of force prior to release can be greatly increased. This results in a significant increase in upward jarring forces. Such increase in jarring force is achieved without over stressing either collet 22 or 24 that may result in failure of the jar apparatus A.

The collet 26 and shoulder 10*n* are arranged oppositely facing to collets 22 and 24 for releasably securing the tubular members 10 and 12 for delivering a downwardly directed jar. This jarring blow is delivered in a manner identical to that previously described, but results from the increased weight of the drill string S supported above the jar apparatus A. If desired, the collet 26 may be reversed in position and the shoulder 10*n* relocated to function on the up jar and eliminate the down jar capability. The illustrated arrangement with the collets 22 and 24 functioning with the up jar and the collet 26 with the down jar is preferred due to the dual capability flexibility of jarring use.

FIG. 2 illustrates the tubular members 10 and 12 in the secured position or ready condition to deliver an up jar with the collets 22 and 24 operably engaged with shoulders 10*l* and 10*m*, respectively. When in this up jar secured position or the ready condition, the shoulder 10*n* is longitudinally spaced from the shoulder 26*g* of the oppositely facing collet 26 that forms the down jar secured position or ready condition. This axial or longitudinal spacing distance x represents the distance or range of telescopic movement of the tubular members 10 and 12 when in the normal operating status or ready condition. As long as the longitudinal compressive or tensile force applied to the jar apparatus A is within normal anticipated operating range the relative tubular member movement is limited to the intermediate position between the two separate securing positions establishing the ready condition as illustrated in FIG. 2 or FIG. 4. In the latter figure the ready to jar engagement of the shoulders 10*n* and 26*g* prevent further telescopic movement of the tubular member 10 into the bore 16 and the intermediate position movement x is illustrated by the distance between disengaged shoulders 10*l* and 22*g*. Note that the hammer shoulder 10*f* and anvil shoulder 12*a* are spaced apart at this securing position in order that down jar impact blow may be developed when the resistance of the collet 26 is overcome and shoulders 10*f* and 12*a* are impacted. The identical spacing between shoulders 22*g* and 10*l* and shoulders 24*g* and 10*m* reflects the distance that the tubular member 10 has telescoped into the bore 16 while remaining in the secured or ready to jar condition. The length of the telescopic movement of the members 10 and 12 in the intermediate position is referenced as x in FIG. 2 and corresponds to the longitudinal distance between collet shoulder 26 and shoulder 10*n*. In other words, the axial or longitudinal distance x of the intermediate position movement or stroke of the tubular members 10 and 12 is formed by and between the up jar ready and down jar ready positions.

A comparison of FIGS. 2 and 3 reflects the changes in condition of the jar apparatus A when the tool is actuated to effect the upwardly directed jarring force. In FIG. 2, the jar apparatus A is in the ready condition or secured position existing when a tension force acts on tubular members 10 and 12. When that tension force exceeds the holding or securing force of the collets 22 and 24, the apparatus A quickly changes to the fully extended condition of FIG. 3 for engaging hammer shoulder 10*h* with anvil shoulder 12*f* to produce the jar blow.

FIG. 4 illustrates the down jar ready condition of the jar apparatus A when the drill string S is providing a compressive loading to the tubular members 10 and 12 prior to jarring. When the securing strength of collect 26 is overcome by the weight of the drill string S acting on the jar apparatus A, the tubular member 10 will drop down in the bore 16 until the hammer shoulder 10*f* engages the anvil shoulder 12*a* to deliver the compressive weight energy as the desired blow.

FIG. 7 illustrates a modified embodiment of the jar apparatus A in which like references characters increased by 100 are used to designate like parts. For example, the inner tubular member 10 becomes 110 and so on. In this embodiment the mounting location of the collets and latch shoulder is reversed. The collets 124 and 126 are mounted on the inner tubular member 110 while the co-acting tapered latch shoulders 130 and 132, respectively, are formed on the outer tubular member 112. In this embodiment, the collets 124 and 126 are modified to provide threaded securing skirts 124*m* and 126*m* for operably fixing or mounting the collets 124 or 126 on the member 110. In this embodiment the collet 124 provides the releasable securing force for the up jar while the collet 126 provides the releasable securing in the ready condition for the down jar. The normal operating range or movement of the tubular members 110 and 112 when in the securing position or ready condition is illustrated in FIG. 7 by the longitudinal spacing of the shoulders 130 and 132 which longitudinal distance is also referenced as x. This normal range of ready condition movement in the intermediate or securing position of the tubular members 110 and 112 also enables delivering of repeated blows in a desired direction without risk of an inadvertent triggering a blow in the opposite direction. The use and operation of this embodiment of FIG. 7 is otherwise virtually identical to the embodiment of FIG. 2.

As described above the telecopying tubular members are longitudinally movable between the fully stretched or longitudinally extended up jarring position (FIG. 3) and the fully longitudinally compressed position down jarring position. While the length of this longitudinal operating movement may be chosen as desired between the stretched and compressed positions, it is preferable that it be kept as short as possible to minimize any angular misalignment between the tubular members 10 and 12. Preferably the total longitudinal operating telescopic movement stroke between tubular members 10 and 12 will be in the range of three (3) feet or 36 inches, but those skilled in the art may utilize a longer or shorter normal longitudinal operating stroke length of the tubular members without departing from the present invention. The relative longitudinal travel distance between tubular members 10 and 12 when delivering a joining blow after release of the securing members should be approximately 6 to 8 inches in distance between the intermediate position and the up joining (fully extended) position or the down joining (fully compressed) position.

As described above the tubular members 10 and 12 also have a normal operating or intermediate position providing the ready condition or two cocked securing position for generating jarring blow. The longitudinal length of the intermediate position (between the up and down jar ready or securing positions) is in the range of substantially twenty-four (24) inches as indicated at x. This range of free movement in the cocked, intermediate or ready to jar position gives the driller a sufficient feel or reaction time to prevent over travel engagement at the other securing position and the resulting inadvertent jarring in the opposite direction with most wells. in straight, shallow wells where drill string elongation is not as great and more precise weight control of the drill string is possible to reduce the risk of over travel the intermediate position may be substantially shorter than twenty-four (24) inches in length. From a practical standpoint, the minimum distance of travel will be approximately one foot or 12 inches. In deviated or deep wells where drill string weight control at the surface is not as a reliable indicator of actual conditions existing at the jar apparatus, it will or may be desirable to lengthen the spacing distance of the intermediate position to more than twenty-four (24) inches to prevent the inadvertent jar actuation in the undesired direction. From a practical standpoint the maximum distance of travel will be approximately 2 feet or 24 inches although a longer travel distance can be utilized.

Such stroke length and intermediate position spacing distance or length should also be adequate to prevent inadvertent jarring by the rebound dynamic force from a desired jarring blow. Depending on where the string is stuck the relative weights of the string above and below the jar and other factors, the jarring rebound or other dynamic force loadings can exceed the holding force of the mechanical receiving means in the opposite direction.

Use and Operation

In the use and operation of the jar apparatus A of the present invention, the apparatus is assembled in the manner illustrated and transported to the well site for use. The jar apparatus A is then connected at a selected location in the well conduit or drill string S by rotational make up of threads **10*d* and 12*c*** in the usual manner.

Using conventional well conduit support equipment the jar apparatus A is reciprocated to position the tubular member 10 and 12 at the ready to jar ready condition or normal operating location at the intermediate position between the extended position or compressed positions, if not done so during assembly.

When in the ready condition, the range of longitudinal slack movement in the two secured positions between members 10 and 12 is limited to the intermediate position x between the oppositely facing collet shoulder engagements. Rotational movement is transmitted through the inter-engaged splines **10*h* and 12*g* in the usual manner. The collets 22, 24 and 26 are designed to carry the anticipated normal or usual tensile and compressive axial force loadings on the tubular members 10 and 12** to maintain the ready condition and avoid inadvertent actuation or operation of the jar apparatus A during other than jarring well operations.

When it becomes necessary or desirable to utilize the jar apparatus A, the operator will either lift on the drill string S to apply an increased tensile loading for effecting an upwardly directed blow or slack off to apply sufficient drill string weight to effect a downwardly directed jarring force. These operations are monitored at the surface with conventional drill string weight indicators.

If a downwardly directed impact is selected, the weight of the well conduit will initially move the tubular member 10 downwardly relative to the outer tubular member 12 until lower collet detent shoulder **26*g* engages the locking annular shoulder 10*n* (FIG. 4). With this tapered shoulder engagement, the tubular members 10 and 12 will remain in the same intermediate relative position or ready condition while the application of the weight of the well conduit or drill string S to the engaged tapered shoulder 26*g* and 10*n* continues to increase. When the weight exceeds the support capability of the collet 26, the arms 26*e* the collet 26 will radially expand or flex to release the shoulders 26*g* and 10*n* from securing engagement. This sudden release from the secured position or ready to jar condition will enable rapid downward movement of the tubular member 10 until the downwardly facing hammer shoulder 10*f* strikes or impacts the upwardly facing anvil shoulder 12*a*. The resulting downwardly directed jar impact is transmitted through the tubular member 12 to the connected portion of the drill string below threads 12*c***.

To reset the jar apparatus, the operator then elevates or picks up on the drill pipe S. As the tubular member 10 moves with the elevated drill pipe it shifts from the telescopically compressed position back to the operating or intermediate position. Upon initial movement into the normal operating or intermediate secured position the upwardly facing shoulder **26*g* of the detent 26*f* will move past the downwardly facing shoulder 10*n* for enabling the resilient arms 26***e* to move the detent shoulder 26*g* radially inwardly to again enable engagement with shoulder 10*n* and cock the jar apparatus A. The jar apparatus A is now restored to the ready to jar condition. If the operator continues to elevate the drill string S, the detent shoulders 22*g* and 24*g* will engage the latch shoulders 10*l* and 10*m*. When this engagement occurs, the operator will notice a sharp increase in tension on the drill pipe S and can quickly stop further elevation of the drill pipe s that would eventually trigger an up jar. Due to the stroke length in the intermediate position the driller can simply elevate a known distance without incurring a sensed increased in drill string weight and still be assured a down jar will result when he backed off. By quickly backing off and again lowering the well conduit, a second down force jar can be produce or created. The sequence for effecting down jarring can be repeated as desired or as required to accomplish a well operation.

If an upwardly directed jarring impact is desired, the operator simply increases the upward pull on the drill string s. This will move the tubular member 10 to bring annular securing shoulders 10*l* and 10*m* into securing engagement with detente shoulders 22*g* and 24*g*, respectively. Such engagement will secure the tubular members 10 and 12 in the ready condition while the drill string s is further tensioned. When the tension force exceeds the wedge holding strength of the tapered shoulder engagement, the collet arms 22*e* and 24*e* will flex to release the tapered detent shoulders 10*l* and 10*m*, respectively, from the securing engagement. The induce tension strain on the drill string S will then jerk the tubular member 10 rapidly upward until hammer collar 10*g* strikes or impacts anvil shoulder 12*f*. This motion limit stop produces the sudden jarring impact which is transmitted in an upward direction to lower portion of the drill pipes connected by the threads 12*d*.

To repeat the upwardly directed impact, the operator simply slacks off to lower the drill pipe S. The ready condition is restored as soon as the shoulders 10*l* and 10*m* enable the collet arms 22*e* and 24*e*, respectively, to radially contract to establish shoulder engagement. As the tubular member 12 continues to move toward the compressed position the detent shoulder 26*g* engages the shoulder 10*n*. When this engagement occurs the operator will be able to detect a decrease in the weight of the well conduit being supported. Due to the longitudinal length of the intermediate position the driller does not have to rely on this weight indication which could result is an undesired down jar. By immediately lifting on the drill pipe S inadvertent triggering of the down jar will be avoided. To deliver a second up jar, the operator need only to commence lifting the drill pipe S. Such sequence of operation may be repeated as desired to effect a corresponding sequence of upwardly directed jarring forces.

The foregoing disclosure and description of the invention are illustrative and explanatory thereof, and various changes in the size, shape and materials, as well as in the details of the illustrated construction may be made without departing from the spirit of the invention.

What I claim is:

1. A jar apparatus adapted for mounting in a tubular well conduit to enable contained internal flow of well fluids and for delivering a controlled impact force in either longitudinal direction to the well conduit when positioned in a well bore, including:

a first inner tubular member forming a longitudinally extending flow passage and having means for releasably mounting said inner tubular member in the well conduit with said flow passage communicating with the bore of the tubular well conduit;

a second outer tubular member forming a longitudinally extending flow passage and having means for releasably connecting said outer tubular member in the well conduit with said flow passage communicating with the bore of the tubular well conduit;

said outer tubular member concentrically disposed relative to said inner tubular member and arranged for providing a limited range of telescoping movement therebetween not greater than around thirty-six (36) inches;

means on said outer tubular member and said inner tubular member for preventing relative circumferential rotational movement while enabling a limited range of telescoping movement therebetween;

anvil means mounted on said outer tubular member for receiving a hammer blow from said inner tubular member;

hammer means formed on said inner tubular member for impacting said anvil means on the outer tubular member for impacting said anvil means on the outer tubular member to impact a shock force to said outer tubular member, the engagement of said anvil means and said hammer means limiting the relative telescoping movement of said tubular members between an extended position and a compressed position to define a longitudinal operating stroke between said positions;

at least two vertically spaced securing means mounted between said inner and outer tubular members for releasably securing said tubular members together in a ready cocked position intermediate the longitudinal operating stroke for the delivery of a hammer blow from either longitudinal direction, each of said securing means including a detent shoulder on one tubular member facing in one direction and a coacting engaging shoulder on the other tubular member facing in an opposite direction, the detent shoulder and coacting engaging shoulder for one securing means facing in opposite directions from the corresponding detent shoulder and coacting engaging shoulder for the other securing means, said detect shoulders and said coacting engaging shoulders being in longitudinally spaced disengaged position on said inner and outer tubular members when out of the intermediate cocked positions;

the cocked intermediate position of the securing means for an upward hammer blow being at a different time and at a different intermediate position of the securing means of said operating stroke from the cocked intermediate position for a downward hammer blow, one of said securing means being releasable from an engaged intermediate position upon the exertion of a predetermined upward tension force from said inner tubular member and the other of said securing means being releasable upon the exertion of a predetermined downward compressive force from said inner tubular member;

the engaged intermediate position for one securing means being a ready cocked position intermediate the stroke between said extended position and said compressed position for enabling the delivery of an impact jar from upward movement of said inner and tubular members in response to movement of said inner tubular member from such intermediate position to extended position, the engaged intermediate position for the other securing means being a ready cocked position intermediate the operating stroke between said extending and compressed positions for enabling the delivery of an impact jar from downward movement of said inner tubular member in response to movement of said inner tubular member from said other engaged intermediate position to compressed position;

said one engaged intermediate position being spaced a substantial predetermined vertical distance from said other engaged intermediate position to minimize inadvertent actuation of a securing means when returning said tubular members to a desired intermediate position for repeating the sequence of operation, the length between said engaged intermediate positions being in the range of around twenty-four (24) inches to provide free movement for the cocked positions, the travel between said tubular members after release of said securing means being between around six (6) and eight (8) inches.

2. A jar apparatus adapted for mounting in a tubular well conduit for delivering a controlled impact force in either longitudinal direction to the well conduit when positioned in a well bore, including:

a first inner member having means for releasably mounting said inner tubular member in the well conduit;

a second outer member having means for releasably connecting said outer tubular member in the well conduit;

said outer member concentrically disposed relative to said inner member and arranged for providing a limited range of telescoping movement therebetween not greater than around thirty-six (36) inches;

means on said inner and outer tubular members for preventing relative circumferential rotational movement therebetween while enabling a limited range of telescoping movement therebetween;

anvil means mounted on said outer member for receiving a hammer blow from the inner member;

hammer means formed on said inner tubular member for impacting said anvil means to impart a shock force to said outer tubular member, the engagement of said anvil means and said hammer means limiting the relative telescoping movement of said first and second members between an extended position and a compressed position to define a longitudinal operating stroke between said positions;

at least two vertically spaced collet means mounted between said inner and outer tubular members for releasably securing said tubular members together in a ready cocked position intermediate the longitudinal operating stroke for the delivery of a hammer blow from either longitudinal direction, each of said collet means including a detent shoulder on one tubular member facing in one direction and a coating engaging shoulder on the outer tubular member facing in an opposite direction, the detent shoulder and coating engaging shoulder for one collet means facing in an opposite direction from the corresponding detent shoulder and coacting engaging shoulder for the other collet means, said detent shoulders and said coacting engaging shoulders being in longitudinally spaced disengaged position on said inner and outer tubular members when out of the intermediate cocked positions;

the cocked intermediate position of the releasably secured collet means for an upward hammer blow being at a different time and at a different intermediate position of said operating stroke from the cocked intermediate position of the releasably secured collet means for a downward hammer blow, one of said collet means being releasable upon the exertion of a predetermined upward force from said inner tubular member and the other of said collet means being releasable upon the exertion of a predetermined downward force from said inner tubular member;

said other collet means being disengaged and spaced a substantial predetermined longitudinal distance from its engaged location when said one collet means is engaged at its intermediate position thereby to minimize inadvertent actuation of said other collet means when said tubular members are returned for a repeat operational sequence, the length between the engaged intermediate positions of the collet means being in the range of around twenty-four (24) inches to provide free movement for the cocked intermediate positions of said collet means, the travel between said tubular members after release of said collet means being between around six (6) and eight (8) inches.

* * * * *